United States Patent [19]

Melfi et al.

[11] 4,412,407

[45] Nov. 1, 1983

[54] MOUNTING ARRANGEMENT FOR GUARD RAIL POST

[75] Inventors: Samuel T. Melfi, 520 NE. Wavecrest Ct., Boca Raton, Fla. 33432; Nicholas J. Melfi, 680 SW. 14th St., Deerfield Beach, Fla. 33441

[73] Assignees: Samuel T. Melfi; Anna J. Melfi, both of Boca Raton; Nicholas J. Melfi, Deerfield Beach, all of Fla.

[21] Appl. No.: 307,731

[22] Filed: Oct. 2, 1981

Related U.S. Application Data

[63] Continuation-in-part of Ser. No. 273,359, Jun. 15, 1981, abandoned.

[51] Int. Cl.[3] ..... E04B 1/38

[52] U.S. Cl. ..... 52/699; 52/309.1; 52/701; 52/705; 52/707

[58] Field of Search ..... 52/698, 699, 700, 701, 52/705, 704, 706, 707, 708, 125.3, 125.4, 125.5, 309.1

[56] References Cited

U.S. PATENT DOCUMENTS

| | | | |
|---|---|---|---|
| 1,305,692 | 6/1919 | Curry | 52/698 |
| 2,794,336 | 6/1957 | Ballou | 52/705 |
| 3,018,055 | 1/1962 | Meier | 52/705 X |
| 3,150,429 | 9/1964 | Shaffer | 52/699 |
| 3,166,815 | 1/1965 | Rappas | 52/701 |
| 3,216,171 | 11/1965 | Jenkins | 52/707 |
| 3,590,538 | 7/1971 | Holt | 52/705 |
| 3,798,856 | 3/1974 | Gloskowski | 52/749 |
| 4,069,629 | 7/1978 | Piazza | 52/125.5 |
| 4,233,787 | 11/1980 | Piazza | 52/125.5 |

FOREIGN PATENT DOCUMENTS

| | | | |
|---|---|---|---|
| 1907793 | 9/1969 | Fed. Rep. of Germany | 52/705 |

*Primary Examiner*—Price C. Faw, Jr.
*Assistant Examiner*—Richard E. Chilcot, Jr.
*Attorney, Agent, or Firm*—Oltman & Flynn

[57] ABSTRACT

For anchoring the lower end of a support post for a guard rail at the edge of a concrete floor or stairway in a building under construction, a helical wire nut is positioned inward from a perimeter board of the form for the floor or stairway. A vertical bolt having its lower end threadedly received in the nut is supported by an angle bracket mounted on the perimeter board of the form.

1 Claim, 7 Drawing Figures

MOUNTING ARRANGEMENT FOR GUARD RAIL POST

CROSS-REFERENCE TO RELATED APPLICATION

This application is a continuation-in-part of our copending U.S. patent application Ser. No. 06/273,359, filed June 15, 1981.

SUMMARY OF THE INVENTION

This invention relates to a mounting arrangement for the lower end of an upstanding post which supports a guard rail near the perimeter of a concrete floor or steps on a multi-story building.

Typically, in the construction of a multi-story building after the concrete floor slab for the balcony or the like has been poured in place on the outside of the building and has hardened, the workmen will stand and move about on that floor slab in performing other work in the construction of the building. This requires a temporary guard rail supported above and around the perimeter of the floor slab to prevent a workman from falling off accidentally. The same need for a guard rail support may exist where monolithic concrete floor and beam structures and concrete steps are to be poured in a building under construction.

In accordance with the presently-preferred embodiments of this invention, an insert for anchoring the lower end of a temporary guard rail support post is positioned to be embedded in the concrete structure near its perimeter. This insert includes a nut in the form of a helically wound wire which has its successive turns engaging each other. A vertical screw-threaded bolt has its lower end threadedly received in the wire nut. This bolt extends up through a flat annular metal washer above the wire nut and through a rigid spacer sleeve above the washer. An angle bracket presents a horizontal top leg which overlies the spacer sleeve and presents an opening there through which the bolt extends. This angle bracket is nailed to an upstanding perimeter board of the form for the concrete structure so as to position the bolt and the other parts of the assembly at the desired short distance inward from the perimeter of the concrete structure. A clamping nut threadedly engages the bolt above the horizontal top leg of the angle bracket and clamps the assembly in place on the form.

After the concrete has been poured and has set, the clamping nut at the top, the angle bracket, the screw-threaded bolt, the spacer sleeve, and the washer just below it are removed. This leaves the wire nut embedded in the concrete and leaves a screw-threaded passage down through the wire nut exposed at the top to threadedly receive a screw-threaded stem on the lower end of a support post for a temporary guard rail which will be used until it is time to install a permanent railing. When this time comes, the support post for the temporary railing may be removed by unscrewing it from the wire nut embedded in the concrete.

A principal object of this invention is to provide a novel and improved arrangement for anchoring a support post for a temporary guard rail at the exposed perimeter of a floor or steps on a building under construction.

Another object of this invention is to provide such an arrangement in which a nut for threadedly receiving the lower end of the temporary guard rail support post is held in the desired position close to the perimeter of the concrete structure while the concrete is being poured and later while the concrete is hardening.

Another object of this invention is to provide such an arrangement which does not interfere with the workmen during the pouring of the concrete.

Further objects and advantages of this invention will be apparent from the following detailed description of certain presently-preferred embodiments thereof, which are shown in the accompanying drawings.

Before explaining the disclosed embodiments of the present invention in detail, it is to be understood that the invention is not limited in its application to the details of the particular arrangements shown since the invention is capable of other embodiments. Also, the terminology used herein is for the purpose of description and not of limitation.

DETAILED DESCRIPTION

Figure 1:
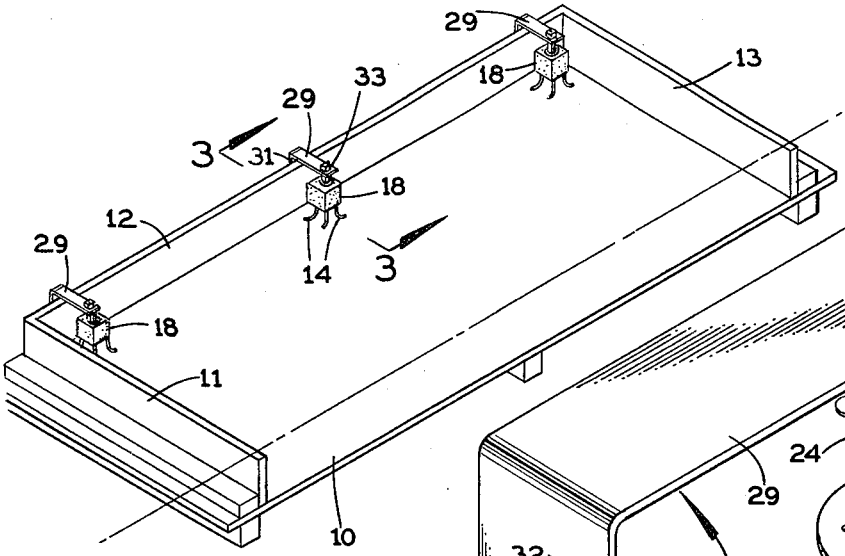
FIG. 1 is a perspective view of a plywood floor and perimeter form assembly for a concrete floor slab, with several of the present inserts in place along one side of the perimeter form.

Referring to FIG. 1, before an above-ground concrete floor slab, such as an elevated balcony, is poured in place on a building under construction, the standard practice is to provide a form for the floor slab including a flat, horizontal plywood panel 10, usually ¾ inch thick, and upstanding perimeter boards 11, 12 and 13 which define three sides of the perimeter of the floor slab. This form is suitably attached to the side of the building (not shown) which defines the fourth side of the perimeter of the floor slab. After the concrete floor slab has been poured into this form and has hardened, a temporary guard rail must be placed around the perimeter of the floor slab for the protection of the workers.

The present insert is embedded in the floor slab to locate and anchor the lower end of an upstanding post for supporting the temporary railing. The temporary railing and its support posts remain mounted on the floor slab until the work on that part of the building has proceeded far enough for a permanent railing and its support posts to be installed.

Figure 2:
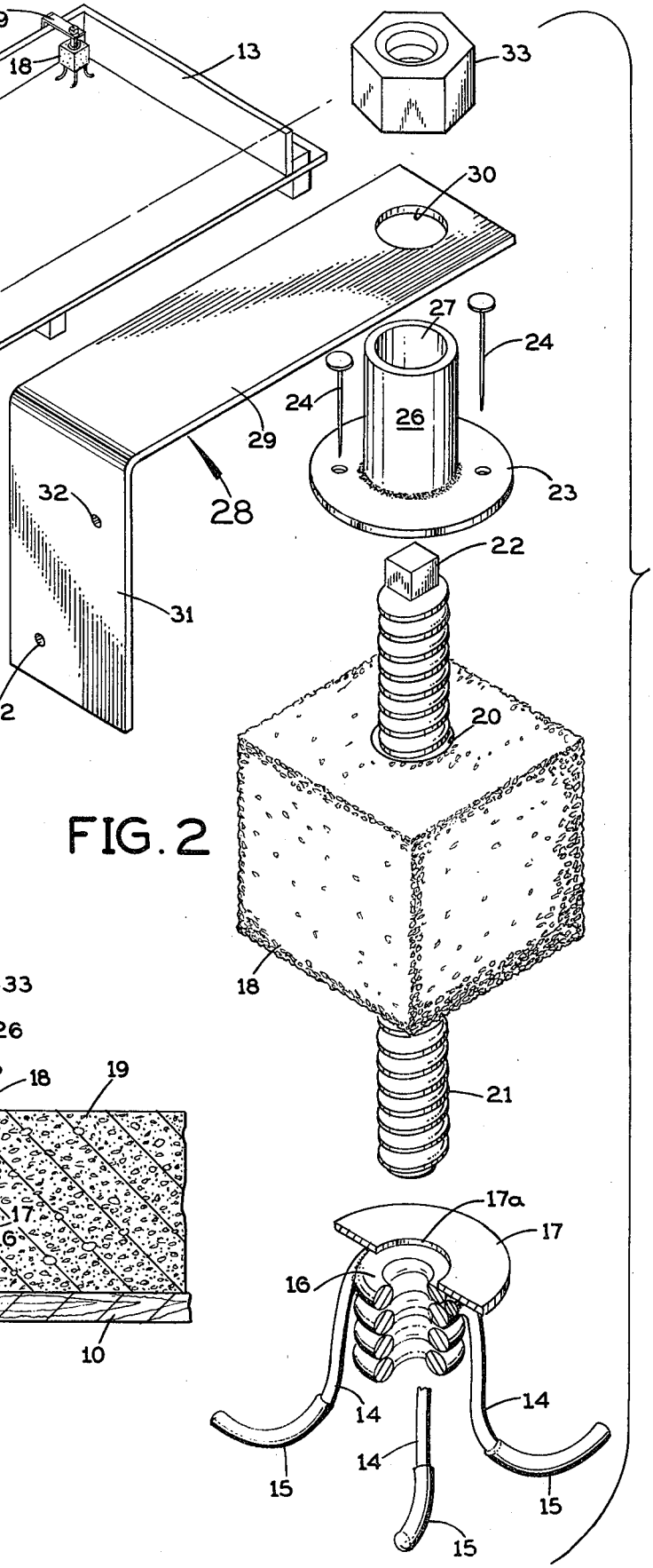
FIG. 2 is an exploded perspective view of the present insert and its positioning arrangement.
Figure 3:
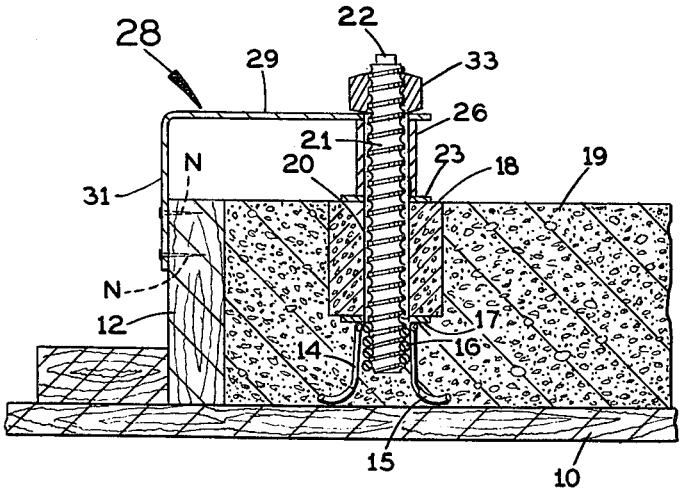
FIG. 3 is a vertical cross-section showing the insert and its positioning arrangement after the concrete floor slab has been poured.

Referring to FIG. 2, the present insert has four support legs 14, each having a rounded convex lower end coated with a plastic layer 15 which rests on the plywood form 10 as shown in FIG. 3. Each support leg is welded at its upper end and sides to the outside of a helically wound wire 16, which has its successive helical turns abutting against each other to form a nut whose screw threads are defined by the inside of the turns of this wire. The four support legs engage the form 10 below at approximately equal intervals circumferentially around the wire nut 16. A flat, annular, metal washer 17 is welded to the top of the wire nut 16 to extend horizontally when the feet 14 rest on the horizontal plywood form 10 for the floor slab. This washer is formed with a circular opening 17*a* at the center which registers with the screw-threaded passageway down through the wire nut 16, and it has a substantially larger outside diameter than the wire nut.

A styrofoam cube 18 rests on the washer 17 while the concrete floor slab 19 (FIG. 3) is being poured. This cube is formed with a central vertical opening 20 of circular cross-section which registers with the washer opening 17*a* and the screw-threaded passageway down through the wire nut 16. The horizontal width of the cube 18 in each direction is substantially greater than the outside diameter of the washer 17 on top of the wire nut 16.

An externally screw-threaded bolt 21 extends rotatably through the vertical opening 20 in the styrofoam block 18 and the washer opening 17*a* and has its lower end threadedly received in the wire nut 16, as shown in FIG. 3. The upper end of this bolt carries a reduced square projection 22 for engagement by a wrench to facilitate screwing the bolt down into the wire nut 16 and later screwing it back out.

A flat, annular, metal washer 23 is fastened to the top of the styrofoam block 18 by a pair of nails 24. This washer has a circular central opening 25 which registers with the openings 20 in block 18 and rotatably receives the screw-threaded bolt 21. A cylindrical metal sleeve 26 is welded on top of the upper washer 23. This sleeve has a central opening 27 of circular cross-section which registers with the washer opening 25 and rotatably passes the screw-threaded bolt 21.

An L-shaped metal angle bracket 28 has its horizontal upper leg 29 resting on top of the sleeve 27, with a circular opening 30 in this leg of the bracket registering with the sleeve opening 27 and rotatably receiving the screw-threaded bolt 21. As shown in FIG. 1, this horizontal leg 29 of the angle bracket extends laterally from the bolt 21 across the top of the adjacent perimeter board 12 of the form. The angle bracket presents a depending vertical leg 31 which extends down across the outside of the perimeter board 12 and is attached to it by nails N (FIG. 3) extending through openings 32 (FIG. 2) in this leg.

A clamping nut 33 is threaded onto the upper end of the screw-threaded bolt 21 immediately above the horizontal top leg 29 of the angle bracket, which is clamped tightly between this nut and the top of sleeve 26.

Before pouring the concrete for the floor slab 19, the wire nut 16 is placed on the plywood floor form 10 with its feet 14 resting on the form, as shown in FIG. 3. The clamping nut 33 is threaded onto the bolt 21 and, with the bolt inverted, the angle bracket 28 is slipped down over the bolt until it engages the clamping nut 33, after which the integral spacer sleeve 26 and washer 23 are slipped down over the bolt, followed by the styrofoam cube 18. Then the nails 24 are driven into the styrofoam cube 18 to fasten it to the washer 23. Now this assembly is re-inverted to the right side up position (with clamping nut 33 at the top). The lower end of the screw-threaded bolt 21 now is screwed down into the wire nut until its lower end is flush, or substantially so, with the bottom of the lowermost turn of the wire nut. The depending vertical leg 31 of the angle bracket 28 is nailed to the adjacent perimeter board 12 and then the clamping nut 33 is tightened. The spacing of the top opening 30 in the angle bracket 28 from its vertical leg 31 determines the location of the wire nut 16 and the rest of the insert assembly inward from the perimeter board 12.

The concrete floor slab is poured after the required number of the just-described inserts are in place at different locations along the perimeter boards of the form. The concrete may be poured up to the level of the top of the styrofoam block 18. The screw-threaded bolt 21 has a sufficiently close fit inside the wire nut 16 that the wet concrete does not flow up inside the wire nut beyond the lower end of the bolt. Also, the contiguous engagement between the successive turns of the wire nut 16 prevents the wet concrete from flowing into the interior of the nut from the outside between the turns. When the concrete hardens, the feet 14, wire nut 16, lower washer 17 and styrofoam block 18 are embedded in the concrete.

The screw-threaded bolt 21 now may be removed by rotating it in a direction for causing its lower end to move up along the inside of the wire nut 16 which is now anchored in the concrete floor slab 19. After the bolt 21 completely disengages from the wire nut 16 it may be lifted out of the concrete floor slab 19. The nut 33, angle bracket 28 and sleeve 26 also are removed, either before or after the removal of the screw-threaded bolt 21. The styrofoam block 18 is dissolved by pouring gasoline down onto it.

Figure 4:
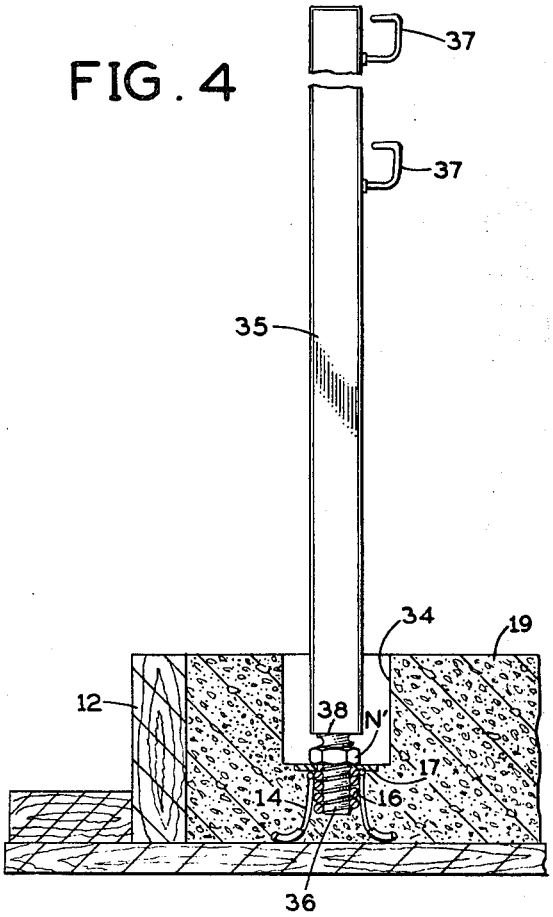
FIG. 4 is a vertical section showing the present insert anchoring the lower end of a post for a temporary guard rail at the perimeter of the concrete floor slab.

As shown in FIG. 4, the foregoing procedure leaves the feet 14, wire nut 16 and washer 17 encased in the concrete floor slab. Above the washer 17 the floor slab has a rectangular recess 34 left by the elimination of the styrofoam cube 18. This recess is open at the top of the floor slab 19.

A support post 35 (FIG. 4) for a temporary guard rail may be screwed down into the wire nut 16 to mount this post in the floor slab 19. This post carries hooks 37 on one side for receiving and supporting chains or pipes (not shown) which extend generally horizontally from one support post 35 to the next to provide the temporary guard railing. The post 35 has a reduced, screw-threaded stem 36 on its lower end which is threadedly received in the floor-embedded wire nut 16. A hex nut N' on the screw-threaded support post stem 36 is located between the washer 17 on top of the wire nut 16 and a downwardly-facing annular shoulder 38 on the post 35 at the upper end of its stem 36. The post 35 may be screwed down into the nut 16 to a position in which the hooks 37 face inward away from the adjacent perimeter board 12 of the floor form. Then the hex nut N' is tightened down against the washer 17 to hold the post 35 tightly in this position.

This insertion of a post 35 takes place at each of the wire nuts embedded in the concrete floor slab 19. The chains or pipes of the temporary guard rail are placed over the hooks 37 after all of the posts 35 are in place, thereby forming perimeter railings above and around the floor slab 19 to prevent a workman from falling off while doing other work on the building.

Figure 5:
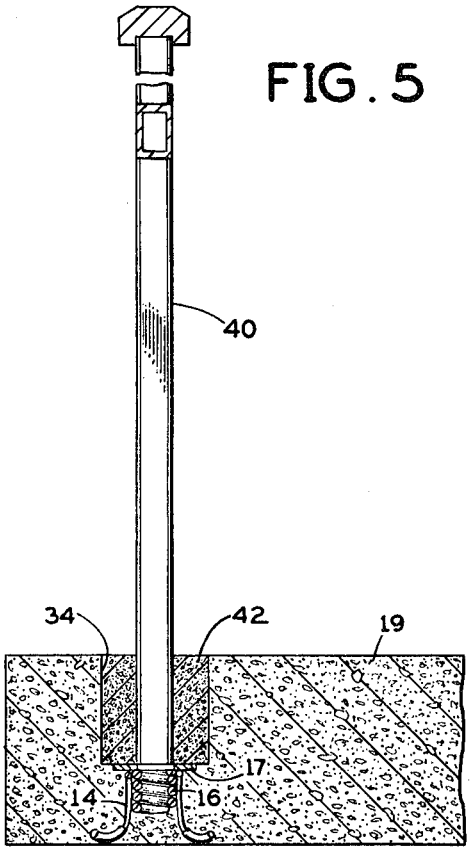
FIG. 5 is a similar view showing the lower end of a post in a permanent guard rail embedded in the concrete floor slab above the present insert.

After the need for a temporary guard railing has passed, support posts 40 (FIG. 5) for a permanent guard rail may be anchored in place in the floor slab 19. Each of these permanent guard rail posts is inserted down into the floor slab recess 34, resting on top of the washer 17 on the upper end of the wire nut 16, after which concrete 42 is poured down into the floor recess 34 to fill in around the lower end of the post 40 and anchor it to the floor slab 19.

Figure 6:
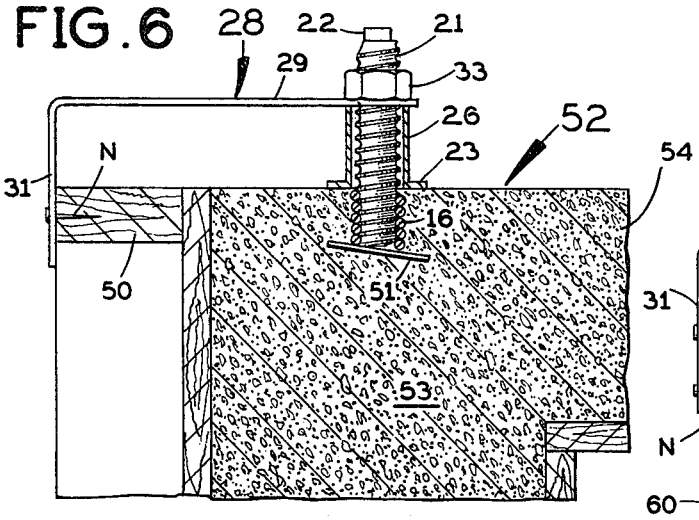
FIG. 6 is a view similar to FIG. 3 and showing a second embodiment of the invention used in a monolithic concrete floor slab and vertical beam in a building under construction.

FIG. 6 shows a second embodiment of the invention which is particularly advantageous for use when a concrete floor slab and a vertical support beam for the floor slab are poured as a single monolithic structure.

In this embodiment the support feet 14 and the lower washer 17 are omitted. The washer 23 rests on top of the wire nut 16. The entire assembly of the wire nut 16, washer 23, spacer sleeve 26, screw-threaded bolt 21 and nut 33 is suspended in place by the angle bracket 28, which is fastened to a perimeter board 50 at the upper end of the form for the beam-floor slab monolith. A ¼ inch diameter steel rod 51 is welded to the bottom of the wire nut and extends transverse to it to anchor the wire nut in the concrete.

The concrete 52 is poured to substantially the level of the bottom of washer 23 to form both a vertical beam 53 and a floor slab 54. As the concrete hardens, the wire nut 16 becomes anchored in the concrete, after which the nut 33 is removed from the bolt 21, the bolt itself is removed from the wire nut 16, and the washer 23, spacer sleeve 26 and angle bracket 28 are removed. This leaves the anchored wire nut 16 accessible at the top for the insertion of a complementary screw-threaded lower end of a support post (not shown) for a temporary guard rail. After the temporary guard rail is no longer needed, its support post may be removed and concrete may be poured down into the embedded wire nut 16 to fill the opening.

Figure 7:
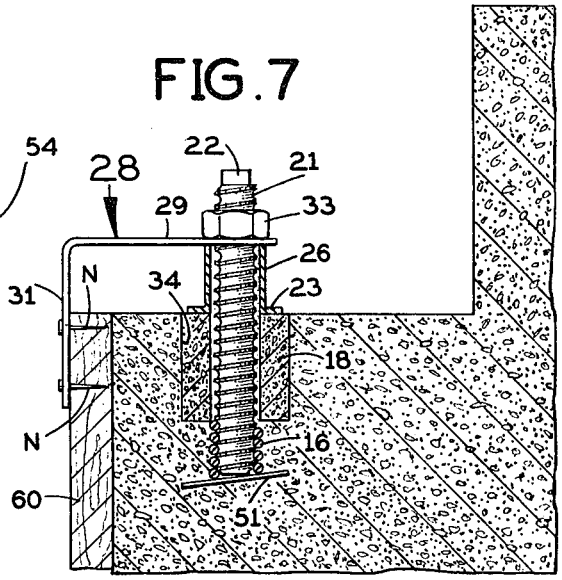
FIG. 7 is a view similar to FIGS. 3 and 6 and showing a third embodiment of the invention used in concrete steps in a building under construction.

FIG. 7 shows a third embodiment of the invention which is used essentially the same way as the embodiment of FIG. 6 in a concrete structure in the form of steps. However, in FIG. 7 the styrofoam block 18 is used, the same as in the embodiment of FIGS. 1–5. This block supports the washer 23 and spacer sleeve 26 from below. The bottom of block 18 rests on top of the wire nut 16. Before the concrete is poured, the entire assembly of the wire nut 16, anchoring rod 51, screw-threaded bolt 21, styrofoam block 18, washer 23, spacer sleeve 26 and nut 33 is suspended from the perimeter board 60 of the form by the angle bracket 28.

After the concrete has been poured and has hardened, the nut 33, spacer sleeve 26, washer 23 and bolt 21 are removed, and the styrofoam block 18 is dissolved by gasoline. This leaves the wire nut 16 and anchor rod 17 encased in the concrete, leaving the wire nut open at its upper end for receiving the screw-threaded lower end of a support post (not shown) for a temporary guard rail. The recess 34 left in the concrete after the elimination of the styrofoam block 18 may be filled with concrete when a permanent guard rail is installed, as shown and described with reference to FIG. 5.

If desired, the styrofoam block 18 in FIG. 7 may be omitted, in which case the wire nut 16 would be long enough vertically to reach the bottom of washer 23 and support it from below in the same manner as in FIG. 6. This type of anchoring insert would be used where no permanent guard rail will be installed after removal of the temporary guard rail.

We claim:

1. For use in anchoring an upstanding guard rail support post to a concrete floor slab, the improvement which comprises:

a helically wound wire nut having its successive helical turns engaging each other and defining a downwardly extending screw-threaded passageway for threadedly receiving a screw-threaded stem on the lower end of the support post;

a rigid elongated bolt having an externally screw-threaded lower end threadedly received in said screw-threaded passageway in the nut, said bolt extending up from said nut above the level to which the concrete floor slab is to be poured and having a screw-threaded upper end;

a bracket having a horizontal top leg with a vertical opening therein which passes said bolt and a vertical leg extending down from said top leg for attachment to a perimeter board of a form for the concrete floor slab;

spacer means engaged between said horizontal top leg of said bracket and the top of said nut, said spacer means having a vertical opening therein which passes said bolt; said spacer means comprising:

a lower, rigid, flat, annular washer engaging the top of said wire nut;

a block of expanded plastic extending up from said lower washer to form a complementary recess in said concrete floor slab above said wire nut, said block having a central vertical opening which registers with the screw-threaded passageway in said wire nut;

an upper, rigid, flat, annular washer on top of said block;

and a rigid sleeve extending up from said upper washer to said horizontal top leg of said bracket;

a clamping nut threadedly engaging the screw-threaded upper end of said bolt above said horizontal top leg of the bracket and clamping the latter down against said spacer means;

and a plurality of feet extending down from said nut to engage a bottom wall of the form and hold the wire nut spaced above said bottom wall.

* * * * *